US007607485B2

(12) United States Patent
Fenton et al.

(10) Patent No.: US 7,607,485 B2
(45) Date of Patent: Oct. 27, 2009

(54) TUBING HANGER AND WELLHEAD HOUSING WITH MATING TUBING ANNULUS PASSAGES

(75) Inventors: Stephen P. Fenton, Balmedie (GB); Lars-Petter Sollie, West Perth (AU); Andrew Davidson, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 6 days.

(21) Appl. No.: 11/656,188

(22) Filed: Jan. 22, 2007

(65) Prior Publication Data

US 2007/0169940 A1 Jul. 26, 2007

Related U.S. Application Data

(60) Provisional application No. 60/762,253, filed on Jan. 26, 2006.

(51) Int. Cl.
*E21B 43/01* (2006.01)

(52) U.S. Cl. ..... 166/368; 166/373; 166/382; 166/386; 166/387; 166/344; 166/348; 166/89.2; 166/88.4

(58) Field of Classification Search ..... 166/367–369, 166/373, 378–380, 382, 386, 387, 348, 341, 166/344, 347, 89.3, 88.4, 89.2
See application file for complete search history.

(56) References Cited

U.S. PATENT DOCUMENTS 3,693,714 A * 9/1972 Baugh ..... 166/348
4,274,663 A * 6/1981 Becker et al. ..... 285/24
5,544,707 A * 8/1996 Hopper et al. ..... 166/382
6,062,314 A * 5/2000 Nobileau ..... 166/368
6,227,300 B1 * 5/2001 Cunningham et al. ..... 166/339
6,293,345 B1 * 9/2001 Watkins ..... 166/368
6,302,212 B1 * 10/2001 Nobileau ..... 166/368
6,367,551 B1 * 4/2002 Fenton ..... 166/345
6,470,968 B1 * 10/2002 Turner ..... 166/348
6,705,401 B2 * 3/2004 Buckle et al. ..... 166/337
6,715,554 B1 * 4/2004 Cunningham et al. ..... 166/348
6,763,891 B2 * 7/2004 Humphrey et al. ..... 166/368
6,810,954 B2 * 11/2004 Garrett et al. ..... 166/77.51
6,902,005 B2 * 6/2005 Radi et al. ..... 166/345
6,966,383 B2 * 11/2005 Milberger et al. ..... 166/368
7,013,970 B2 * 3/2006 Collie et al. ..... 166/89.1
7,117,945 B2 * 10/2006 Hopper et al. ..... 166/348
7,240,736 B2 * 7/2007 Fenton et al. ..... 166/358
7,296,629 B2 * 11/2007 Bartlett ..... 166/348
2004/0112604 A1 * 6/2004 Milberger et al. ..... 166/368
2004/0163818 A1 * 8/2004 Fenton et al. ..... 166/368
2005/0126788 A1 * 6/2005 Crozier ..... 166/345
2005/0284640 A1 * 12/2005 Borak, Jr. ..... 166/369

(Continued)

FOREIGN PATENT DOCUMENTS

WO WO01/73259 A1 10/2001

*Primary Examiner*—Thomas A Beach
*Assistant Examiner*—Matthew R Buck
(74) *Attorney, Agent, or Firm*—Bracewell & Giuliani

(57) ABSTRACT

A subsea wellhead assembly has a tubing annulus path that extends partly through the tubing hanger and partly through the wellhead housing. A tubing hanger tubing annulus passage extends through part of the tubing hanger from a lower port on the lower end of the tubing hanger to an upper port on the exterior surface of the tubing hanger below the tubing hanger seal. A wellhead housing tubing annulus passage within the sidewall of the wellhead housing has a lower end at the bore below the tubing hanger seal and an upper end at the bore above the tubing hanger seal. A valve is mounted to the wellhead housing and accessible by an ROV from the exterior for opening and closing the inner wellhead housing tubing annulus passage.

20 Claims, 2 Drawing Sheets

U.S. PATENT DOCUMENTS

2006/0011348 A1* 1/2006 Fenton et al. ..... 166/366
2006/0272823 A1* 12/2006 Hopper et al. ..... 166/368
2008/0017384 A1* 1/2008 Anderson et al. ..... 166/347

* cited by examiner

TUBING HANGER AND WELLHEAD HOUSING WITH MATING TUBING ANNULUS PASSAGES

CROSS-REFERENCE TO RELATED APPLICATION

This application claims priority to provisional application Ser. No. 60/762,253, filed Jan. 26, 2006.

FIELD OF THE INVENTION

This invention relates in general to subsea wellhead equipment, and in particular to a tubing hanger that locates within a wellhead housing, and a tubing annulus passage that extends partially through the tubing hanger and partially through the wellhead housing.

BACKGROUND OF THE INVENTION

A subsea well is drilled in one manner by first drilling or jetting to a first depth, then installing an outer or low pressure wellhead housing at the sea floor, with a first string of casing or conductor pipe extending to the first depth. The operator drills to a second depth, then lands a high pressure or inner wellhead housing in the outer wellhead housing. A second string of casing is attached to the inner wellhead housing and extends into the well to the second depth. The operator connects a drilling riser to the inner wellhead housing and drills the well to a third depth, which may be the total depth in some cases. The operator lands a casing hanger attached to a third string of casing in the inner wellhead housing. The operator might drill deeper and install a second casing hanger.

Once at total depth, in one method, the operator disconnects the drilling riser and runs a tubing hanger and a string of tubing on a completion riser. The tubing hanger has a production passage and an annulus passage, both extending from the lower end to the upper end of the tubing hanger. The completion riser has one conduit that connects to the production passage and another conduit that connects to the annulus passage. After the tubing hanger has been landed, the operator can circulate between the interior of the tubing and the tubing annulus on its exterior by pumping down one conduit and returning up the other. After the well has been perforated and tested, the operator lands a production tree on the inner wellhead housing. The tree has a production bore and an annulus bore. The operator orients or rotates the tree so that its passages align with the passages in the tubing hanger prior to landing.

In another method, before running the tubing hanger, the operator runs a different type of tree, commonly referred to as a "horizontal" tree. The operator runs the tubing hanger through the drilling riser and lands it in the horizontal tree. The tubing hanger has a production fluid side outlet that registers with a side outlet in the tree when properly oriented by the operator. The horizontal tree has a tubing annulus passage that extends from the bore of the tree below the tubing hanger seal to the bore of the tree above the tubing hanger seal. The drilling riser normally has a blowout preventer (BOP) on its lower end and a choke and kill line extending alongside. By closing the BOP on the tubing hanger running string, the operator is able to achieve circulation between the tubing annulus and the production passage in the tubing. A dual completion riser is not required, as in the first method described above.

In a third method, as shown in U.S. Pat. No. 6,715,554, the operator installs a tubing spool on the inner wellhead housing.

The tubing hanger lands and seals in the tubing spool. The tubing spool has a tubing annulus bypass passage with a lower end and an upper end joining the bore. The seal of the tubing hanger is located between the upper and lower ends of the bypass passage. This arrangement enables the operator to circulate through the tubing annulus with a drilling riser connected to the tubing spool in the same manner as with a horizontal tree. The tree lands on top of the tubing spool, and production fluid flows up the tubing spool to the tree.

SUMMARY OF THE INVENTION

The tubing hanger of this invention lands in the bore of a wellhead member for supporting a string of tubing. The tubing hanger has a production passage for fluid communication with the interior of the string of tubing. A tubing hanger seal surrounds the tubing hanger and seals to the bore. A tubing annulus passage extends within the tubing hanger alongside the production passage from a lower port on a lower portion of the tubing hanger to an upper port on the exterior surface of the tubing hanger below the tubing hanger seal. The wellhead member has a tubing annulus passage with a lower end at the bore below the tubing hanger seal and an upper end at the bore above the tubing hanger seal.

Preferably a valve is installed in the tubing annulus passage of the wellhead member. Also, preferably, the valve has an ROV actuator to enable it to be closed or opened by an ROV.

In the preferred embodiment, the tubing hanger lower portion extends into a casing hanger. The upper port of the tubing annulus passage is located above the seal of the casing hanger. A tree lands on the wellhead member and has an isolation sub that stabs sealingly into the production passage of the tubing hanger.

DETAILED DESCRIPTION OF THE INVENTION

Figure 1:
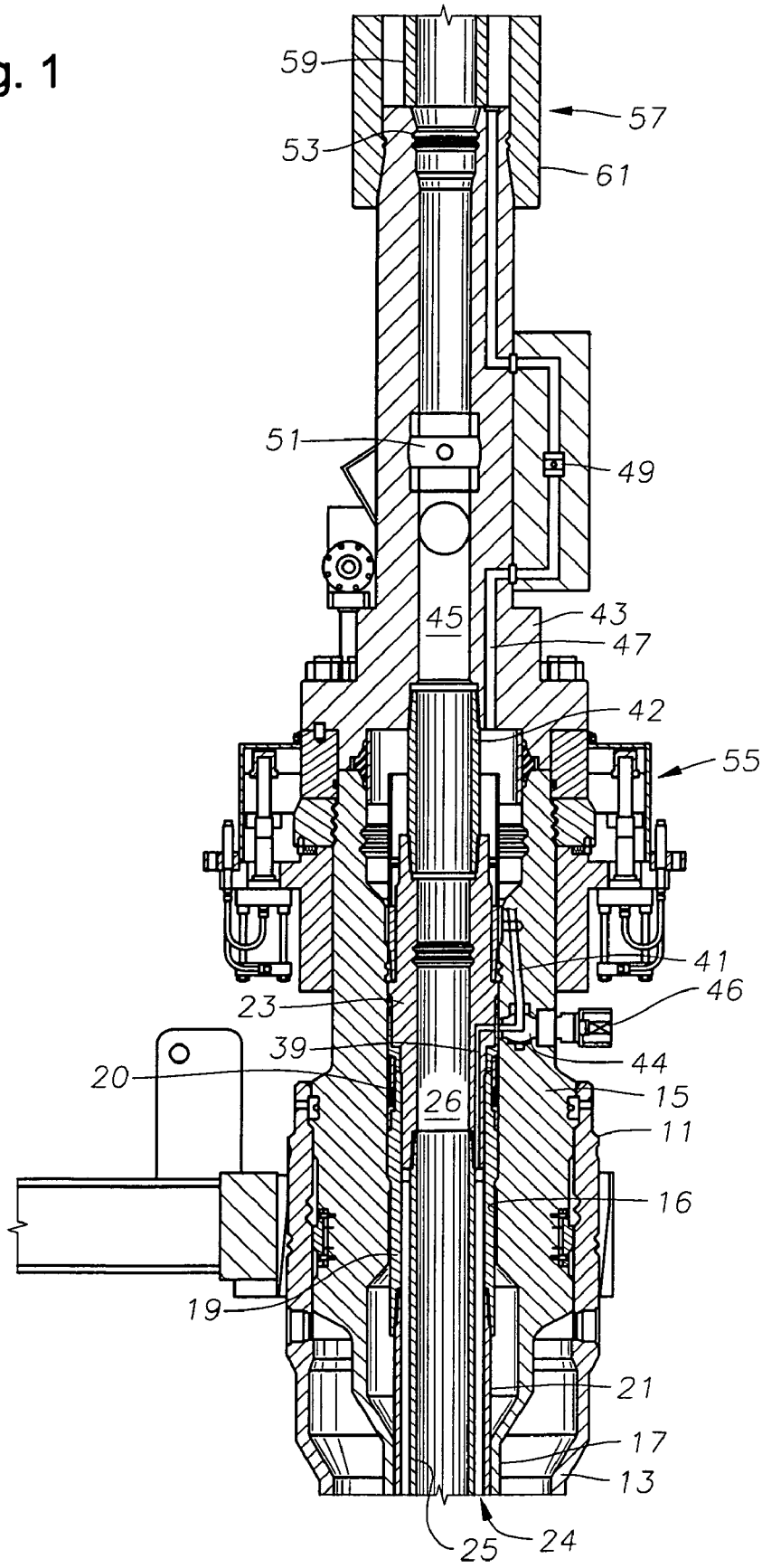
FIG. 1 is a vertical sectional view illustrating a wellhead assembly constructed in accordance with this invention

Referring to FIG. 1, an outer or low pressure wellhead housing 11 is located at the sea floor. Outer wellhead housing 11 is secured to the upper end of a string of conductor pipe 13 that extends to a first depth in the well. An inner or high pressure wellhead housing 15 lands in outer wellhead housing 11. Inner wellhead housing 15 has a bore 16 and extends upward a considerable distance above the upper end of outer wellhead housing 11. A string of casing 17 secures to the lower end of inner wellhead housing 15 and extends to a greater depth in the well. A casing hanger 19 lands and locks in bore 16. Casing hanger 19 is secured to a string of casing 21 and is locked and sealed to bore 16 of inner wellhead housing 15 by a packoff or seal 20. Additional strings of casing could be installed.

Figure 2:
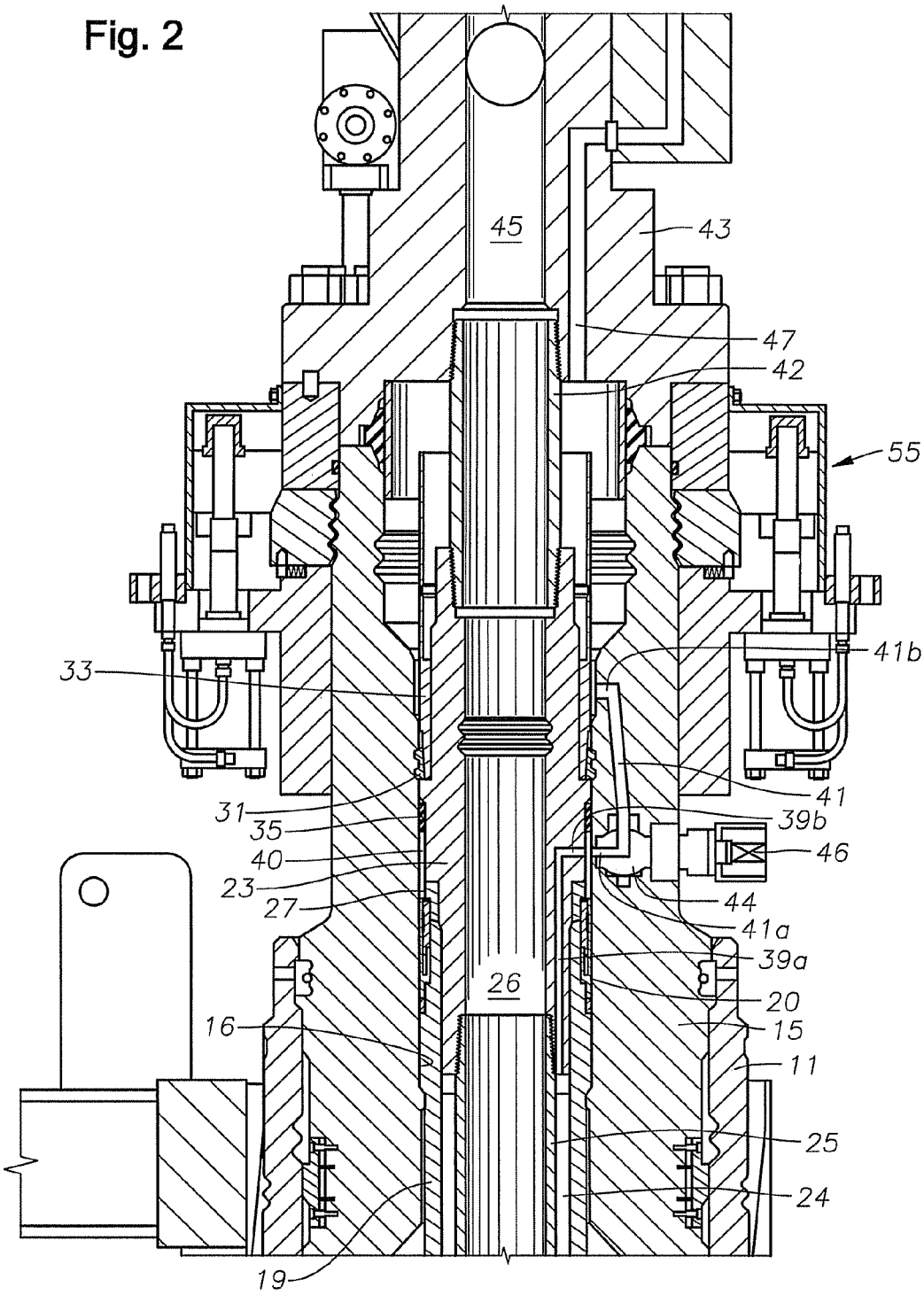
FIG. 2 is a enlarged vertical sectional view of a portion of the wellhead assembly of FIG. 1.

A tubing hanger 23, which is secured to the upper end of a string of tubing 25, lands in inner wellhead housing bore 16. A tubing annulus passage 24 is defined between tubing 25 and casing 21. Tubing hanger 23 has a bore 26 that communicates with the interior of tubing 25. Tubing hanger 23 has a lower portion that inserts into the bore of casing hanger 19. The lower portion does not form a seal with the bore of casing hanger 19 in this example, but it could if desired to isolate the upper side of casing hanger packoff 20 from tubing annulus pressure. Referring to FIG. 2, in this embodiment, tubing hanger 23 has a shoulder ring 27 that lands on an upper end of casing hanger 19, thus the weight of the string of tubing 25 transfers to casing hanger 19, and from there to inner wellhead housing 15.

Tubing hanger 23 has a lockdown ring 31 that engages a profile in wellhead housing bore 16. An energizing ring 33 is moved downward by the tubing hanger running tool (not shown) to actuate lockdown mechanism 31. Tubing hanger 23 has a seal 35 that seals against bore 16 of inner wellhead housing 15. Seal 35 is located on the exterior of tubing hanger 23 above shoulder ring 27. A spacer ring with holes for tubing annulus flow could be located between shoulder ring 27 and seal 35.

A tubing annulus passage 39 extends within tubing hanger 23 from a lower port 39*a* at the lower end of tubing hanger 23 in communication with tubing annulus 24 upward to a point above casing hanger seal 20. Tubing annulus passage 39*a* is parallel to or inclined and offset from tubing hanger production bore 26. Tubing annulus passage 39 has an upper port 39*b* on the exterior of tubing hanger 23 at a point below lockdown 31 in this embodiment. There is an annular clearance around tubing hanger 23 at upper tubing annulus port 39*b*. Tubing annulus passage 39 has an adequate flow area to achieve the desired circulation through tubing annulus 24. If a seal is not employed between the lower portion of tubing hanger 23 and the bore of casing hanger, some flow from tubing annulus 24 can occur through this clearance, however, the clearance does not have an adequate flow area for the desired circulation flow rate.

Inner wellhead housing 15 has a tubing annulus passage 41 with a lower port 41*a* in the sidewall of bore 16 above casing hanger seal 20 and below tubing hanger seal 35. An annular gallery chamber 40 extends around the exterior of tubing hanger 23 at tubing hanger upper port 39*b*, thus lower port 41*a* is in fluid communication with tubing annulus upper port 39*b* whether or not tubing hanger 23 is oriented to align ports 39*b* and 41*a*. Wellhead housing tubing annulus passage 41 extends upward through the sidewall of inner wellhead housing 15 nominally parallel to and offset from bore 16. Wellhead housing tubing annulus passage 41 has an upper port 41*b* at bore 16 above tubing hanger seal 35 for communicating with bore 16 above tubing hanger 23. In this example upper port 41*b* is located adjacent energizing sleeve 33 of tubing hanger lockdown 31.

A tubing annulus valve 44 is operably located within passage 41 for selectively opening and closing passage 41. Preferably valve 44 is located within a cavity machined in high pressure wellhead housing 15. Preferably, valve 44 has an ROV (remote operated vehicle) interface 46 on the exterior of inner wellhead housing 15 for opening and closing with an ROV. Valve 44 establishes a temporary barrier in tubing annulus 24. Tubing annulus valve 44 is shown in one of its many possible forms. For example, tubing annulus valve 44 could be a metal sealing shuffle or plug valve.

An isolation tube 42 stabs into a counterbore formed in the upper end of tubing hanger passage 26. Isolation tube 42 is secured to the lower end of production tree 43. Production tree 43 has a production passage 45 that is coaxial with isolation tube 42 and tubing hanger production passage 26. Tree 43 also has a tubing annulus passage 47 that is offset from and parallel to production passage 45.

As shown in FIG. 1, tree tubing annulus passage 47 has a closure member, preferably a tubing annulus valve 49 that can be opened and closed either through hydraulic lines or by a remote actuated vehicle. Tubing annulus valve 49 may be located directly within tubing annulus passage 47 as shown, or located in an exterior member. Tree 43 also has one or more production valves 51 located in production passage 45. Production passage 45 and tubing annulus passage 47 in this example extend to the upper end of tree 43, which contains a mandrel 53 with a profile for connection to a production riser 57 (shown schematically) extending upward to a production vessel. Production riser 57 could be a dual concentric string of conduit with an inner conduit 59 and outer conduit 61. In this example, inner conduit 59 in riser 57 communicates with production passage 45 and the annulus between the inner and outer conduits 59, 61 communicates with annulus passage 47, requiring no orientation at this connection. Alternately, the production riser could comprise a single string of conduit, with tubing annulus communication supplied in another manner, such as by a separate and smaller conduit alongside the production riser. The latter arrangement would require a means of orientation at that connection.

Tree 43 connects to wellhead housing 15 conventionally with a tree connector 55. In this example, the choke and various additional valves and equipment normally employed with a production tree are located on structure other than the tree, such as a choke bridge module or manifold. Alternately, a more conventional subsea tree could be utilized.

Although not shown, production tubing 25 will normally have a downhole safety valve. One or more hydraulic lines normally lead from the downhole safety valve alongside the tubing to tubing hanger 24. Typically, these auxiliary lines as well as others for other purposes may extend vertically through penetrator passages in tubing hanger 24 for stabbing connection to mating connectors extending downward from tree 43. If so, tree 43 would have to be oriented to mate its connectors with the auxiliary lines. Other methods for controlling a downhole safety valve may be used, however, that do not use penetrators extending vertically through the tubing hanger. If so, tree 43 would not have to be oriented.

In operation, after installing outer wellhead housing 11 and conductor pipe 13, the operator drills deeper, then connects a drilling riser and blowout preventer (not shown) to inner wellhead housing 15, which in turn is connected to casing 17. After landing inner wellhead housing 15 and cementing casing 17, the operator drills through casing 17 to the total depth of the well and installs casing hanger 19 and casing 21. If desired, the operator may then run tubing 25 by securing a tubing hanger running tool (not shown) to tubing hanger 23 and lowering the assembly through the drilling riser until tubing hanger 23 lands on casing hanger 19. Orientation of tubing hanger 23 to align tubing annulus ports 39, 41 is normally not required. Then, with the running tool, the operator secures lockdown 31.

The operator would normally complete the well after installation of tree 43, but other completion methods are feasible. In this example, the operator could install a plug in tubing hanger production passage 26 by lowering it on wire line through the tubing hanger running string while the drilling riser is still connected to inner wellhead housing 15. Tubing annulus valve 44 would be closed. The operator then could remove the drilling riser and install tree 43, which could be done with another drilling vessel at a later date. If so, the operator may install a corrosion cap on inner wellhead housing 15 until tree 43 is run.

When completing in this manner, tree 43 may be installed by lowering it on a running string, such as outer conduit 59 of production riser 61, and connecting tree 43 to inner wellhead housing 15 with tree connector 55. Isolation tube 42 stabs into tubing hanger production passage 26. If a dual concentric riser string is employed, the operator can then lower inner conduit 59 through outer conduit 61 and stab it into engagement with the upper end of tree production passage 45. The operator opens tree annulus valve 49, either hydraulically or by an ROV and employs an ROV to open wellhead housing tubing annulus valve 44. The operator circulates the existing fluid out of tubing annulus 24 by pumping down inner riser conduit 59 and returning up the annulus between conduits 59, 61, or vice versa. In either event fluid from tubing annulus 24 will flow through tubing annulus passages 39 and 41. The operator then uses an ROV to close inner wellhead housing annulus valve 44.

Either before or after circulation, the operator may perforate tubing 25 and test the well. The operator lowers the perforating equipment through production riser 57, tree passage 45 and tubing hanger passage 26. After perforating tubing 25 and testing, the operator may produce the well through inner conduit 59 of dual concentric riser 57.

For workover operations, the operator can circulate through tubing annulus 24 while tree 43 is still installed. If tree 43 is the type shown in the drawings and a dual concentric production riser string employed, the circulation is made through production riser 57, by pumping fluid down inner conduit 59 and returning fluid up the annulus between inner and outer conduits 59, 61 or vice-versa. These passages communicate with the upper ends of production passage 45 and tubing annulus passage 47. An ROV would be employed to open inner wellhead housing annulus valve 44 and optionally open tree annulus valve 59. For workover operations requiring the removal of tubing 25, after killing the well by circulating heavy fluid, the operator would install a plug in tubing hanger production passage 26 and remove tree 43. Subsequently, the operator would connect a workover or drilling riser to inner wellhead housing 15 to remove tubing 25.

An alternate method of completion would be to complete the well by circulating though tubing annulus 24 and perforating before installing tree 43. In that method, the operator would use the drilling riser to complete and circulate. This can be done by closing the blowout preventer on the tubing hanger running string to provide a chamber in inner wellhead housing bore 16 above tubing hanger 23 and below the BOP. The drilling riser has an auxiliary line, such as a choke and kill line, that enables the operator to pump down the running string with the tubing annulus fluid returning up the choke and kill line. After completion, the operator would set a plug in tubing hanger production passage 26, close inner wellhead housing annulus valve 44 and disconnect the drilling riser. Tree 43 would be run then or a later date in the same manner as described above.

The invention has significant advantages. The tubing hanger lands in the wellhead housing as in a conventional tree, but the operator does not need a dual completion riser to circulate through the tubing annulus. The operator is able to complete the well using a drilling riser. The lower portion of the tubing hanger locates within the casing hanger, but still has adequate flow area for the tubing annulus because of the passage within the tubing hanger. The tree may use a dual concentric riser for completion, production and workover.

While the invention has been shown in only one of its forms, it should be apparent to those skilled in the art that it is not so limited but is susceptible to various changes without departing from the scope of the invention.

The invention claimed is:

1. A wellhead assembly, comprising:

a wellhead member having a tubular sidewall defining a bore;

a tubing hanger landed in the bore for supporting a string of tubing, the tubing hanger having a production passage for fluid communication with the interior of the string of tubing;

a tubing hanger seal surrounding the tubing hanger and sealing an exterior surface of the tubing hanger to the bore;

a tubing hanger tubing annulus passage within the body of the tubing hanger extending alongside the production passage from a lower port on a lower portion of the tubing hanger to an upper port on the exterior surface of the tubing hanger below the tubing hanger seal;

a wellhead member tubing annulus passage within the sidewall of the wellhead member, having a lower end at the bore below the tubing hanger seal for communication with the upper port of the tubing hanger tubing annulus passage and an upper end at the bore above the tubing hanger seal; and wherein the tubing hanger tubing annulus passage and the wellhead member tubing annulus passage are sized to enable circulation of fluid along a path down the string of tubing and up the wellhead member tubing annulus passage.

2. The wellhead assembly according to claim 1, further comprising:

a valve mounted to the wellhead member for opening and closing the wellhead member tubing annulus passage.

3. The wellhead assembly according to claim 2, further comprising:

an ROV actuator on the valve to enable the valve to be opened and closed by an ROV.

4. The wellhead assembly according to claim 1, further comprising:

a cavity formed in the wellhead member in communication with the wellhead member tubing annulus passage; and a valve mounted in the cavity for opening and closing the wellhead member tubing annulus passage.

5. The wellhead assembly according to claim 1, further comprising:

a production tree mounted on top of the wellhead member, the production tree having a production passage;

an isolation sub extending from the production passage into sealing engagement with the production passage in the tubing hanger for communicating well fluid from the tubing to the production passage in the tree; and a production tree tubing annulus passage within the tree and having a lower end adjacent the isolation sub for communicating with the upper end of the wellhead member tubing annulus passage.

6. The wellhead assembly according to claim 1, further comprising:

a casing hanger landed in the bore of the wellhead member for supporting a string of casing; and wherein the lower portion of the tubing hanger extends into the casing hanger.

7. The wellhead assembly according to claim 1, wherein the wellhead member comprises:

an inner wellhead housing; and wherein the wellhead assembly further comprises:

an outer wellhead housing, the inner wellhead housing landing within the outer wellhead housing and protruding above.

8. The wellhead assembly according to claim 1, further comprising:

an annular gallery area between the exterior surface of the tubing hanger and the bore of the wellhead member in fluid communication with the upper port of the tubing hanger tubing annulus passage and the lower end of the wellhead member tubing annulus passage.

9. A wellhead assembly, comprising:

an outer wellhead housing secured to a first string of casing;

an inner wellhead housing having a lower portion landed in the outer wellhead housing and secured to a second string of casing, the inner wellhead housing having a tubular sidewall defining a bore;

a casing hanger landed in the bore of the inner wellhead housing and secured to a third string of casing;

a tubing hanger landed in the bore of the inner wellhead housing, the tubing hanger having a lower end extending into the casing hanger and secured to a string of tubing, the tubing hanger having a production passage extending from the lower end to an upper end of the tubing hanger for flowing well fluid from the string of tubing;

a tubing hanger seal surrounding the tubing hanger and sealing an exterior surface of the tubing hanger to the bore above the casing hanger;

a tubing hanger tubing annulus passage within the body of the tubing hanger extending alongside, and having an axis offset and parallel to; the production passage in the tubing hanger from a lower port on the lower end of the tubing hanger to an upper port on the exterior surface of the tubing hanger above the casing hanger and below the tubing hanger seal;

an inner wellhead housing tubing annulus passage extending vertically within the sidewall of the inner wellhead housing, having a lower end at the bore below the tubing hanger seal for communication with the upper port of the tubing hanger tubing annulus passage and an upper end at the bore above the tubing hanger seal;

a valve mounted to the inner wellhead housing and accessible from an exterior of the inner wellhead housing for opening and closing the inner wellhead housing tubing annulus passage; and wherein the tubing hanger tubing annulus passage and the wellhead member tubing annulus passage are sized to enable circulation of fluid along a path down the string of tubing and up the wellhead member tubing annulus passage.

10. The wellhead assembly according to claim 9, further comprising:

an annular gallery area between the exterior surface of the tubing hanger and the bore of the inner wellhead housing in fluid communication with the upper port of the tubing hanger tubing annulus passage and the lower end of the inner wellhead housing tubing annulus passage.

11. The wellhead assembly according to claim 9, further comprising:

an ROV actuator on the valve to enable the valve to be opened and closed by an ROV.

12. The wellhead assembly according to claim 9, further comprising:

a cavity formed in the sidewall of the inner wellhead housing in communication with the inner wellhead housing tubing annulus passage; and wherein the valve is mounted in the cavity.

13. The wellhead assembly according to claim 9, further comprising:

a production tree mounted on top of the inner wellhead housing, the production tree having a production passage;

an isolation sub extending from the production passage in the tree into sealing engagement with the production passage in the tubing hanger for communicating well fluid from the tubing to the production passage in the tree; and a production tree tubing annulus passage within the tree and having a lower end adjacent the isolation sub for communicating with the upper end of the inner wellhead housing tubing annulus passage.

14. The wellhead assembly according to claim 13, further comprising:

a dual concentric production riser connected to the tree and extending to a production facility, the production riser having an inner conduit that communicates with the production passage in the tree, the production riser having an outer conduit that defines an annulus between the inner and outer conduits that communicates with the tree tubing annulus passage.

15. A method of drilling and completing a subsea well, comprising:

(a) providing a tubing hanger having a production passage, a tubing hanger seal, a tubing hanger tubing annulus passage within the body of the tubing hanger extending from a lower portion of the tubing hanger upward to an upper port on the exterior of the tubing hanger below the tubing hanger seal;

(b) providing a wellhead housing having a bore and a wellhead housing tubing annulus passage with a lower end and an upper end, both terminating at the bore;

(c) with a drilling vessel, installing a wellhead housing at the sea floor, connecting a drilling riser to the wellhead housing and drilling through the riser and the wellhead housing to a selected depth;

(d) running a string of casing through the riser and landing a casing hanger in the wellhead housing;

(e) securing the tubing hanger to a string of production tubing, lowering the tubing hanger and production tubing through the drilling riser, landing the tubing hanger in the bore of the wellhead housing, and sealing the exterior of the tubing hanger to the bore with the tubing hanger seal located between the lower and upper ends of the wellhead housing tubing annulus passage; and (f) circulating fluid from the drilling vessel along a flow path defined by a tubing annulus surrounding the production tubing, the tubing hanger tubing annulus passage, and the wellhead housing tubing annulus passage.

16. The method according to claim 15, wherein:

step (b) further comprises mounting a valve in the wellhead housing tubing annulus passage; and wherein the method further comprises:

closing the valve after step (f).

17. The method according to claim 16, wherein the step of closing the valve is performed with an ROV.

18. The method according to claim 15, further comprising after step (e) and before step (f), disconnecting the drilling riser from the wellhead housing, landing a production tree on the wellhead housing, and performing step (f) by circulating through passages in the tree.

19. The method according to claim 15, wherein comprising after step (e) and before step (f):

disconnecting the drilling riser from the wellhead housing;

landing a production tree on the wellhead housing, the production tree having a production passage and an annulus passage, each having access at an upper end of the tree;

connecting a dual concentric riser to the production tree, with an inner conduit in communication with the production passage and an outer conduit in communication with the annulus passage; then pumping down one of the conduits and returning fluid up the other of the conduits to perform step (f).

20. The method according to claim 19, further comprising producing production well. fluid through the tubing, the production passages in the tubing hanger and the tree and up the inner conduit of the dual concentric riser.

* * * * *

UNITED STATES PATENT AND TRADEMARK OFFICE

CERTIFICATE OF CORRECTION

PATENT NO. : 7,607,485 B2
APPLICATION NO. : 11/656188
DATED : October 27, 2009
INVENTOR(S) : Fenton et al.

It is certified that error appears in the above-identified patent and that said Letters Patent is hereby corrected as shown below:

In Column 3, Line 54, delete "shuffle" and insert -- shuttle --, therefor.

In Column 5, Line 33, delete "though" and insert -- through --, therefor.

In Column 7, Line 21, in Claim 9, delete "to;" and insert -- to --, therefor.

In Column 10, Line 2, in Claim 20, delete "well." and insert -- well --, therefor.

Signed and Sealed this

Sixteenth Day of February, 2010

David J. Kappos

David J. Kappos
*Director of the United States Patent and Trademark Office*